US007788749B1

(12) United States Patent
Ku

(10) Patent No.: US 7,788,749 B1
(45) Date of Patent: Sep. 7, 2010

(54) FOLDABLE NECK/WAIST SUPPORT

(76) Inventor: Ming-Chou Ku, 13F., No.8, Huimin Rd., Xitun Dist., Taichung City 407 (TW)

( * ) Notice: Subject to any disclaimer, the term of this patent is extended or adjusted under 35 U.S.C. 154(b) by 0 days.

(21) Appl. No.: 12/578,361

(22) Filed: Oct. 13, 2009

(51) Int. Cl.
*A47C 20/02* (2006.01)

(52) U.S. Cl. ..... 5/637; 5/640; 5/643; 297/393; 297/397

(58) Field of Classification Search ..... 5/637, 5/640, 643, 628, 924; 128/845, 869, 870; 297/391, 393, 397, 398
See application file for complete search history.

(56) References Cited

U.S. PATENT DOCUMENTS 4,928,711 A * 5/1990 Williams ..... 5/628
4,964,418 A * 10/1990 Wilson ..... 128/857
5,944,016 A * 8/1999 Ferko, III ..... 128/869
6,158,813 A * 12/2000 Karash ..... 297/391
6,176,549 B1 * 1/2001 Karash ..... 297/391

* cited by examiner

*Primary Examiner*—Michael Trettel
(74) *Attorney, Agent, or Firm*—Jackson IPG PLLC; Demian K. Jackson

(57) ABSTRACT

A foldable neck/waist support includes a foldable board and a soft pad. The foldable board includes a central flat portion, a pair of inner oblique portions extending from two opposing sides of the central flat portion, a pair of outer oblique portions extending from the pair of inner oblique portions, a pair of insertion portions extending from the pair of outer oblique portions. The soft pad is a rectangular sheet to be stuck on the central flat portion and the pair of inner oblique portions with adhesive to form one piece. The soft pad has two opposing ends extending over the pair of inner oblique portions. An engaging slot is not coated with adhesive. When fording the present invention, top dents formed on the foldable board are bent rearward such that the outer oblique portions and the insertion portions are folded behind the central flat portion. When assembling the present invention, the top dents are pushed forward and inner dents and outer dents are pushed rearward. The insertion portions are folded backward along the outer dents. An engaging tab is inserted through the engaging slot and secured in place by a pair of hook-shaped notches. The gaps which are formed between each of the pair of support sections and the engaging tab provide a holding effect to form a pair of symmetrical hollow triangular prisms. The present invention can be used to support the neck or the waist of a user, and is light and compact for carrying with ease.

5 Claims, 6 Drawing Sheets

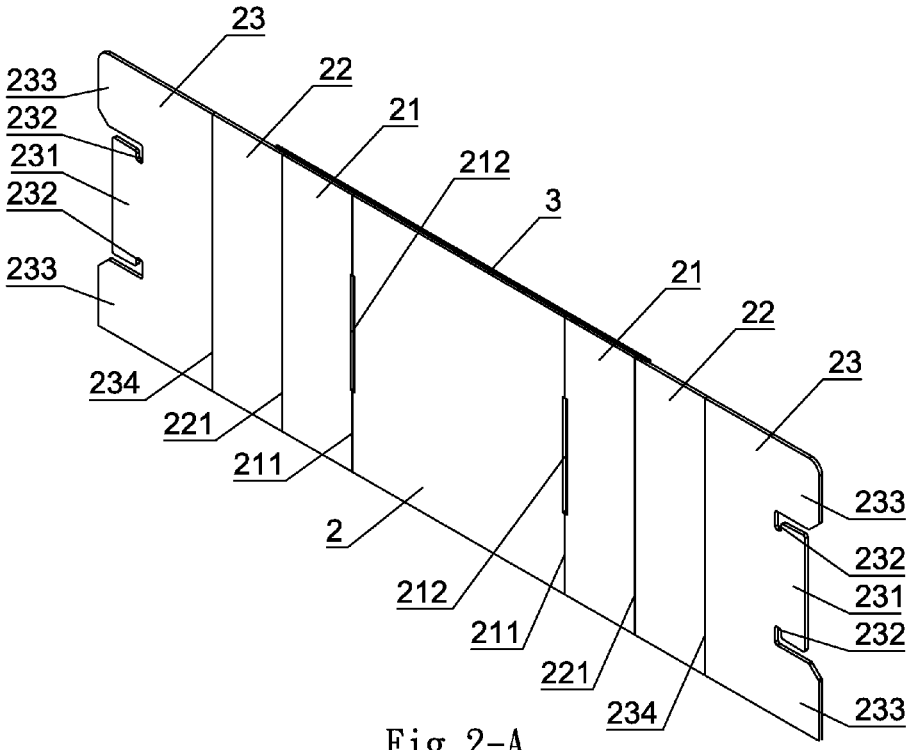
Fig. 2-A
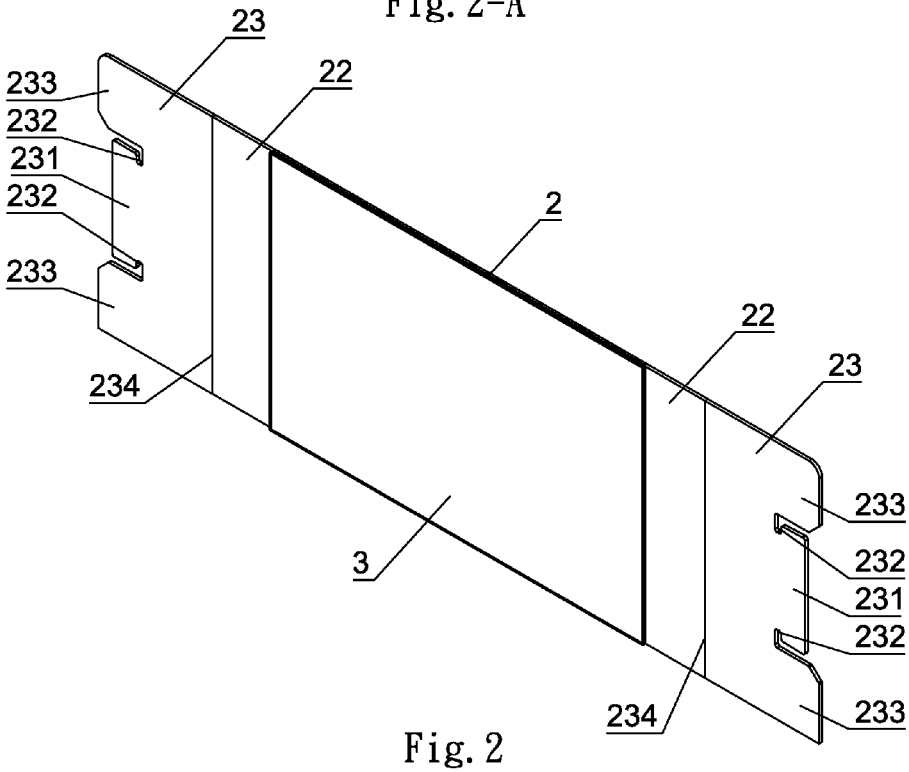
Fig. 2

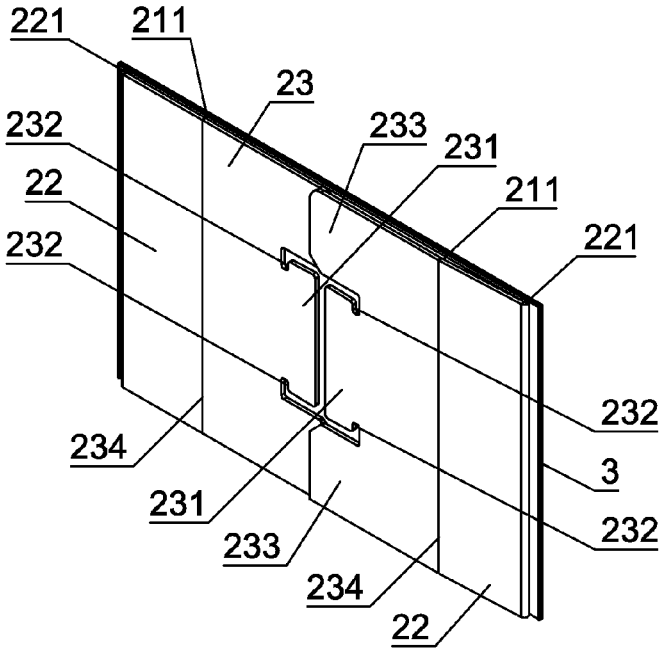
Fig. 3-A
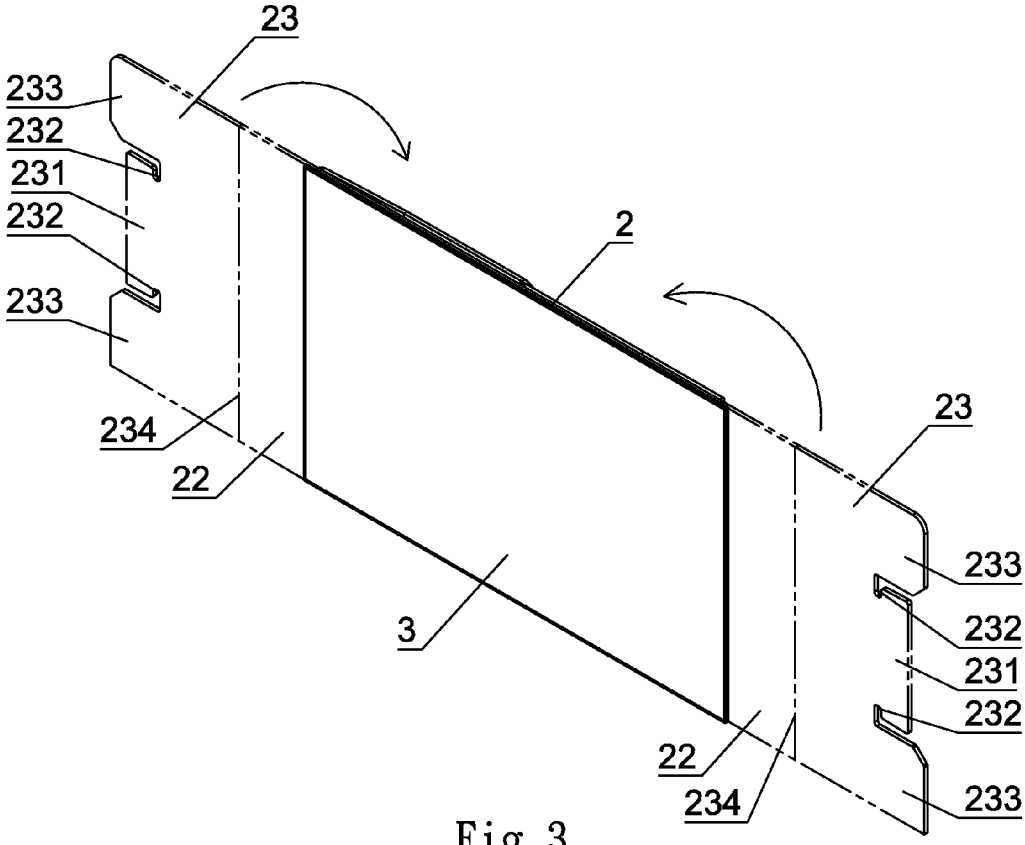
Fig. 3

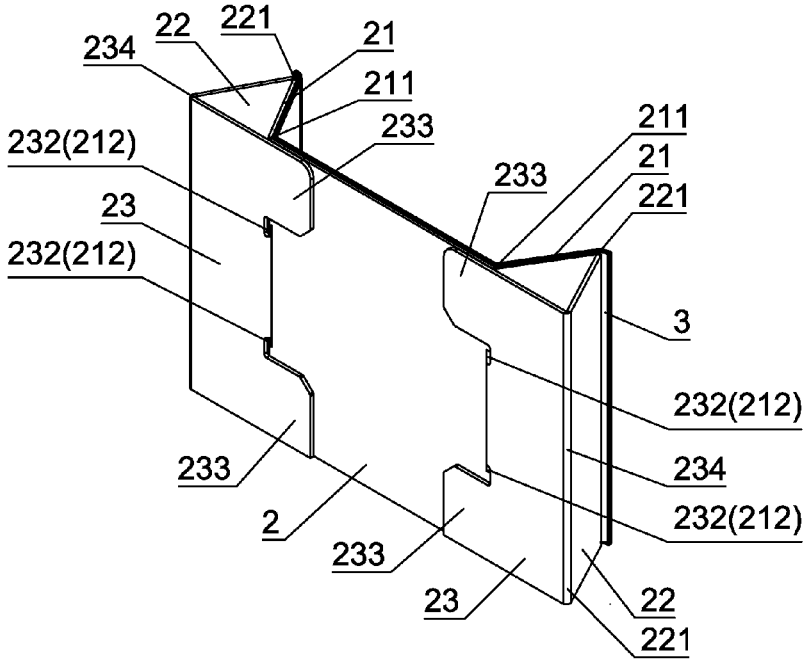
Fig. 4-A
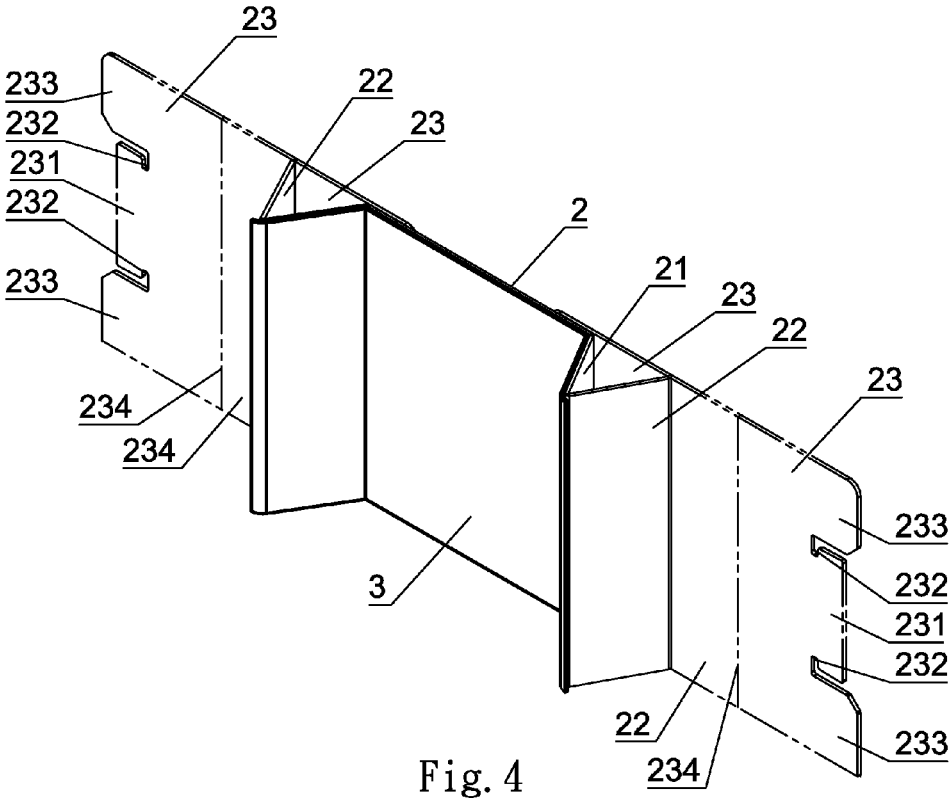
Fig. 4

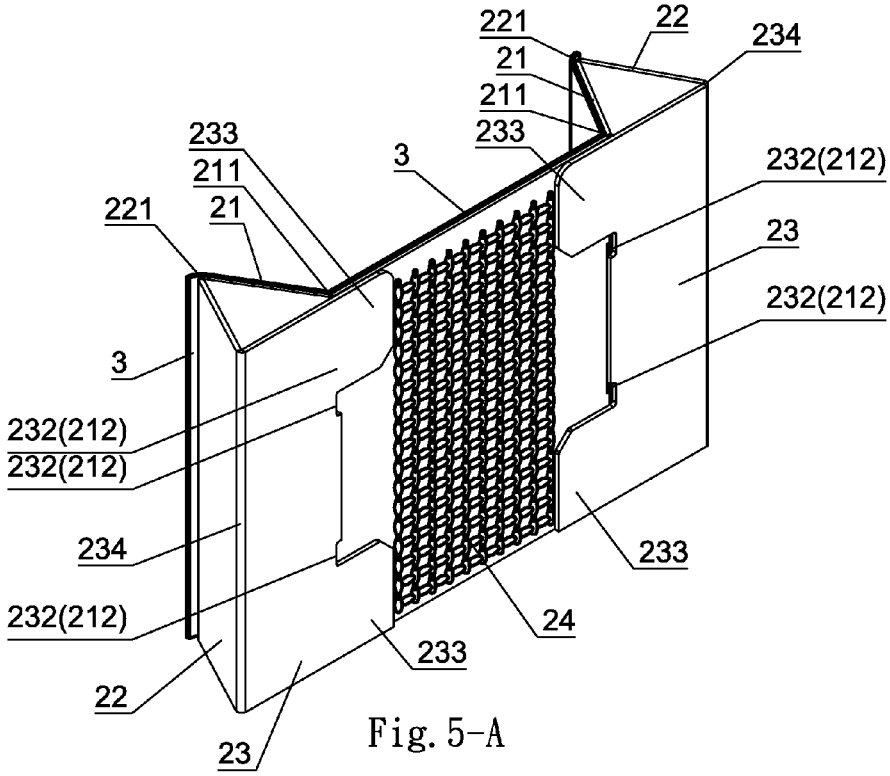
Fig. 5-A
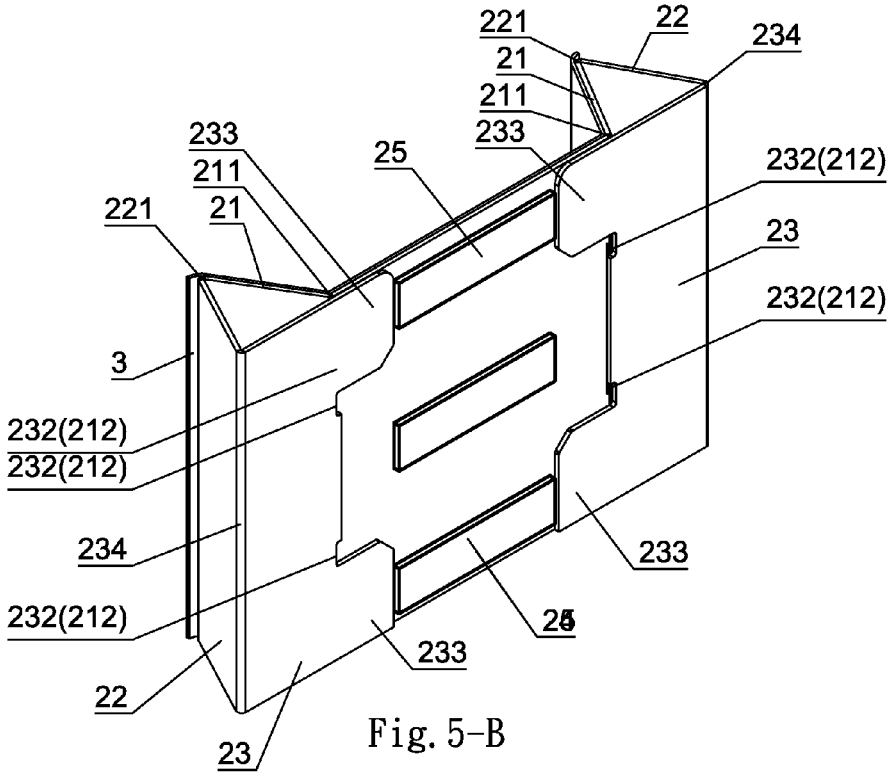
Fig. 5-B

FOLDABLE NECK/WAIST SUPPORT

BACKGROUND OF THE INVENTION

1. Field of the Invention

The present invention relates to a foldable neck/waist support, and more particularly to one that includes a foldable board and a soft pad. The foldable board includes a pair of inner oblique portions, a pair of outer oblique portions and a pair of insertion portions which are folded to form a pair of symmetrical hollow triangular prisms. An engaging tab is inserted through an engaging slot and secured in place by a pair of hook-shaped notches. The gap formed between each of a pair of support sections and the engaging tab provides a holding effect. The present invention is used to support the neck or the waist of the user, and is light and compact for carrying with ease.

2. Description of the Prior Art

In general, a traveler sits on a chair for a period of time when taking a long-distance journey by car, train, bus, boat, airplane or the like. Most travelers kill time by taking a nap. When taking a nap, the traveler may tilt his/her head to one side. Thus, the neighbor is bothered and the traveler cannot sleep well. There are neck supports or waist supports on the markets. However, they are larger in size and inconvenient for carrying. Accordingly, the inventor of the present invention has devoted himself based on his many years of practical experiences to solve this problem.

SUMMARY OF THE INVENTION

According to the present invention, there is provided a foldable neck/waist support, comprising:

a foldable board including a central flat portion, a pair of inner oblique portions extending from two opposing sides of the central flat portion, a pair of outer oblique portions extending from the pair of inner oblique portions, a pair of insertion portions extending from the pair of outer oblique portions, between the central flat portion and each of the inner oblique portions being formed with an inner dent and an engaging slot disposed at a central portion of the inner dent, between each of the inner oblique portions and each of the outer oblique portions being formed with a top dent, between each of the outer oblique portions and each of the insertion portions being formed with an outer dent, each of the insertion portions being formed with a pair of support sections at an outer side thereof, an engaging tab between the pair of support sections, and a pair of hook-shaped notches defined between the pair of support sections and the engaging tab; and a soft pad, the soft pad being a rectangular sheet to be stuck on the central flat portion and the pair of inner oblique portions to form one piece, the soft pad having two opposing ends extending over the pair of inner oblique portions, the engaging slot being not coated with adhesive for insertion of the engaging tab;

thereby, when in use, the pair of inner oblique portions, the pair of outer oblique portions and the pair of insertion portions being folded to form a pair of symmetrical hollow triangular prisms, the engaging tab being inserted through the engaging slot, the engaging tab being secured in place by engagement of the pair of hook-shaped notches.

The primary object of the present invention is to provide a foldable neck/waist support. Wherein, the soft pad is attached to the foldable board. When folding the present invention, each top dent between the inner oblique portion and the outer oblique portion is bent rearward such that the pair of outer oblique portions and the pair of insertion portions are folded behind the central flat portion to be a flat form for convenient storage and carrying. When assembling the present invention, each top dent between the inner oblique portion and the outer oblique portion is pushed forward, and each inner dent between the central flat portion and the inner oblique portion and each outer dent between the outer oblique portion and the insertion portion are pushed rearward to be a V-shaped form. Then, each insertion portion is folded backward along the outer dent. The engaging tab is inserted through the engaging slot and secured in place by the pair of hook-shaped notches. The gaps which are formed between each of the pair of support sections and the engaging tab provide a holding effect. The present invention is folded to form a pair of symmetrical hollow triangular prisms. The two ends of the soft pad extend over the top dents to alleviate the uncomfortable caused by the triangular prisms. The present invention can be used to support the neck or the waist of a user, and is light and compact for carrying with ease.

The second object of the present invention is to provide a foldable neck/waist support. Wherein, the back of the central flat portion of the foldable board is provided with a non-slip pad or a non-slip tape. The non-slip pad or the non-slip tape is attached to a seat, providing a positioning effect when the present invention when in use. Furthermore, the central flat portion, the inner oblique portions, the outer oblique portions, and the insertion portions of the foldable board can be printed with advertisements, slogans, or jokes for providing promotion and beguiling tedium.

BRIEF DESCRIPTION OF THE DRAWINGS

FIG. 2 is a perspective view of the present invention;

FIG. 2-A is a rear perspective view of the present invention;

FIG. 3 is a schematic view of the present invention in a folding status;

FIG. 3-A is a rear perspective view of the present invention in a folding status;

FIG. 4 is a schematic view of the present invention after being folded;

FIG. 4-A is a rear perspective view of the present invention after being folded;

FIG. 5-A is a perspective view of the present invention provided with a non-slip pad;

FIG. 5-B is a perspective view of the present invention provided with an adhesive tape.

DETAILED DESCRIPTION OF THE PREFERRED EMBODIMENTS

Embodiments of the present invention will now be described, by way of example only, with reference to the accompanying drawings.

Figure 1:
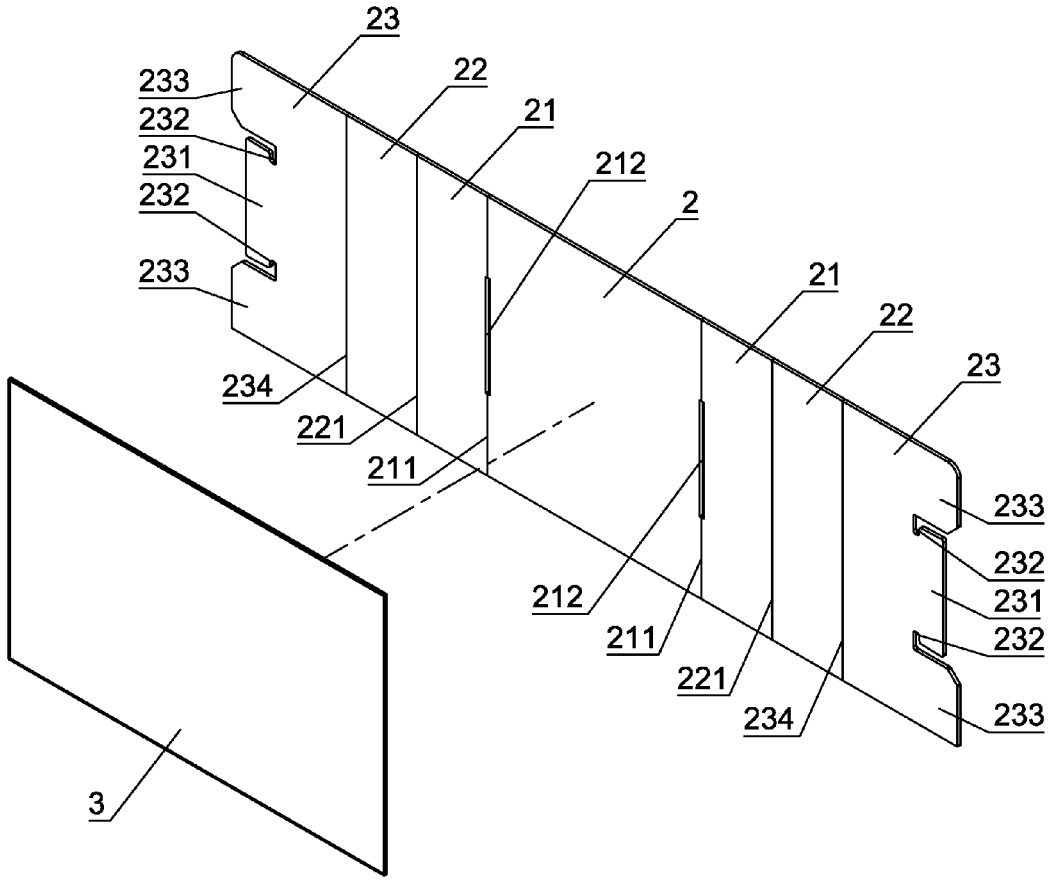
FIG. 1 is an exploded view of the present invention.

Referring to FIG. 1, FIG. 2, FIG. 2-A, the present invention comprises a foldable board 2 and a soft pad 3.

The foldable board 2 includes a central flat portion, a pair of inner oblique portions 21 extending from two opposing sides of the central flat portion, a pair of outer oblique portions 22 extending from the pair of inner oblique portions 21, a pair of insertion portions 21 extending from the pair of outer oblique portions 22. Between the central flat portion and each of the inner oblique portions 21 is formed with an inner dent 211 and an engaging slot 212 disposed at a central portion of the inner dent 211, between each of the inner oblique portions 21 and each of the outer oblique portions 22 is formed with a top dent 221 and between each of the outer oblique portions 22 and each of the insertion portions 23 is formed with an outer dent 234 to provide an accurate folding direction. Each of the insertion portions 23 is formed with a pair of support sections 233 at an outer side thereof, an engaging tab 231 between the pair of support sections 233, and a pair of hook-shaped notches 232 defined between the pair of support sections 233 and the engaging tab 231. When the engaging tab 231 is inserted through the engaging slot 212, the engaging tab 231 will be secured in place by engagement of the pair of hook-shaped notches 232. The gaps which are formed between the pair of support sections 233 and the engaging tab 231 provide a holding effect for stability. The foldable board 2 can be made of paper or plastic material.

The soft pad 3 is a rectangular sheet to be stuck on the central flat portion and the pair of inner oblique portions 21 to form one piece. The soft pad 3 has two opposing ends extending over the pair of inner oblique portions 21. The engaging slot 212 is not coated with adhesive for insertion of the engaging tab 231 of the insertion portion 23. The soft pad 3 can be made of fabrics or silicone.

Figure 6:
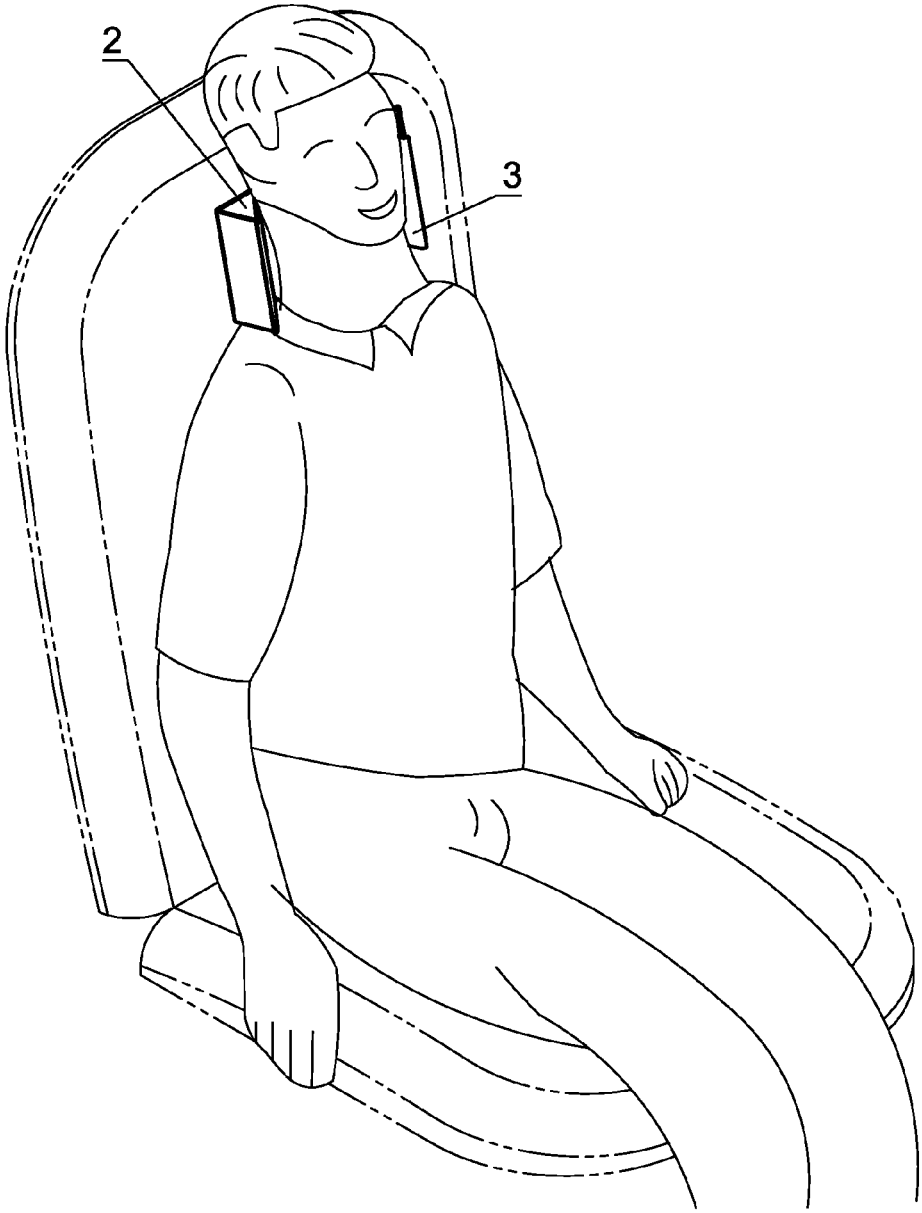
FIG. 6 is a schematic view of the present invention when in use.

Referring to FIG. 3~FIG. 4, FIG. 3~FIG. 4-A, FIG. 6, the soft pad 3 is attached to the foldable board 2. When folding the present invention, each top dent 221 between the inner oblique portion 21 and the outer oblique portion 22 is bent rearward, as shown in FIG. 3, such that the pair of outer oblique portions 22 and the pair of insertion portions 23 are folded behind the central flat portion, as shown in FIG. 3-A, to be a flat form for convenient storage and carrying. When assembling the present invention, each top dent 221 between the inner oblique portion 21 and the outer oblique portion 22 is pushed forward, and each inner dent 211 between the central flat portion and the inner oblique portion 21 and each outer dent 234 between the outer oblique portion 22 and the insertion portion 23 are pushed rearward to be a V-shaped form. Then, each insertion portion 23 is folded backward along the outer dent 234. The engaging tab 231 is inserted through the engaging slot 212 and secured in place by the pair of hook-shaped notches 232. The gaps which are formed between each of the pair of support sections 233 and the engaging tab 231 provide a holding effect. The present invention is folded to form a pair of symmetrical hollow triangular prisms, as shown in FIG. 4 and FIG. 4-A. The two ends of the soft pad 3 extend over the top dents 221 to alleviate the uncomfortable caused by the triangular prisms. The present invention can be used to support the neck or the waist of a user, and is light and compact for carrying with ease.

FIGS. 5-A~B and FIG. 6 show different embodiments of the present invention. The back of the central flat portion of the foldable board 2 is provided with a non-slip pad 24 or a non-slip tape 25. The non-slip pad 24 or the non-slip tape 25 is attached to a seat, providing a positioning effect when the present invention when in use. Furthermore, the central flat portion, the inner oblique portions 21, the outer oblique portions 22, and the insertion portions 23 of the foldable board 2 can be printed with advertisements, slogans, or jokes for providing promotion and beguiling tedium.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A foldable neck/waist support, comprising:

a foldable board including a central flat portion, a pair of inner oblique portions extending from two opposing sides of the central flat portion, a pair of outer oblique portions extending from the pair of inner oblique portions, a pair of insertion portions extending from the pair of outer oblique portions, between the central flat portion and each of the inner oblique portions being formed with an inner dent and an engaging slot disposed at a central portion of the inner dent, between each of the inner oblique portions and each of the outer oblique portions being formed with a top dent, between each of the outer oblique portions and each of the insertion portions being formed with an outer dent, each of the insertion portions being formed with a pair of support sections at an outer side thereof, an engaging tab between the pair of support sections, and a pair of hook-shaped notches defined between the pair of support sections and the engaging tab; and a soft pad, the soft pad being a rectangular sheet to be stuck on the central flat portion and the pair of inner oblique portions to form one piece, the soft pad having two opposing ends extending over the pair of inner oblique portions, the engaging slot being not coated with adhesive for insertion of the engaging tab;

thereby, when in use, the pair of inner oblique portions, the pair of outer oblique portions and the pair of insertion portions being folded to form a pair of symmetrical hollow triangular prisms, the engaging tab being inserted through the engaging slot, the engaging tab being secured in place by engagement of the pair of hook-shaped notches.

2. The foldable neck/waist support as claimed in claim 1, wherein the foldable board is a cardboard or a plastic board.

3. The foldable neck/waist support as claimed in claim 1, wherein the soft pad is made of fabrics or silicone.

4. The foldable neck/waist support as claimed in claim 1, wherein a back of the central flat portion of the foldable board is provided with a non-slip pad or a non-slip tape.

5. The foldable neck/waist support as claimed in claim 1, wherein the central flat portion, the inner oblique portions, the outer oblique portions and the insertion portions of the foldable board are printed with advertisements, slogans, or jokes.

* * * * *